United States Patent [19]

Duynhoven et al.

[11] Patent Number: 4,779,402

[45] Date of Patent: Oct. 25, 1988

[54] MACHINE FOR APPORTIONING AND PACKAGING QUANTITIES OF FRAGILE PARTICULATE PRODUCT

[75] Inventors: Adrianus V. Duynhoven, Deurne, Netherlands; Helmut Leypold, Ditzenger, Fed. Rep. of Germany

[73] Assignee: Robert Bosch GmbH, Stuttgart, Fed. Rep. of Germany

[21] Appl. No.: 66,359

[22] PCT Filed: Sep. 13, 1986

[86] PCT No.: PCT/DE86/00364

§ 371 Date: Jun. 9, 1987

§ 102(e) Date: Jun. 9, 1987

[87] PCT Pub. No.: WO87/02326

PCT Pub. Date: Apr. 23, 1987

[30] Foreign Application Priority Data

Oct. 10, 1985 [DE] Fed. Rep. of Germany ..... 3536173

[51] Int. Cl.[4] ..... B65B 1/30; B65B 63/02

[52] U.S. Cl. ..... 53/529; 53/502; 53/551

[58] Field of Search ..... 53/502, 503, 504, 551, 53/529, 438, 451; 222/55, 56

[56] References Cited

U.S. PATENT DOCUMENTS

| | | | |
|---|---|---|---|
| 2,522,884 | 9/1950 | Mann . | |
| 3,175,337 | 3/1965 | Roberts et al. . | |
| 3,416,619 | 12/1968 | McClusky | 53/502 X |
| 4,123,970 | 11/1978 | Quante | 53/502 X |
| 4,171,067 | 10/1979 | Faulkner et al. | 222/56 X |
| 4,455,810 | 6/1984 | Kreager et al. | 53/551 X |
| 4,520,883 | 6/1985 | Fukuda | 222/56 X |
| 4,580,698 | 4/1986 | Ladt et al. | 222/55 |
| 4,617,862 | 10/1986 | Van Doorn et al. | 53/529 X |
| 4,705,470 | 11/1987 | Penta | 53/520 X |

FOREIGN PATENT DOCUMENTS

| | | |
|---|---|---|
| 162172 | 4/1904 | Fed. Rep. of Germany . |
| 911232 | 5/1954 | Fed. Rep. of Germany . |
| 1057952 | 5/1959 | Fed. Rep. of Germany . |
| 1966092 | 7/1971 | Fed. Rep. of Germany . |
| 2041115 | 2/1972 | Fed. Rep. of Germany . |
| 2109834 | 9/1972 | Fed. Rep. of Germany . |
| 3146094 | 6/1983 | Fed. Rep. of Germany . |

*Primary Examiner*—James F. Coan
*Assistant Examiner*—Steven P. Weihrouch
*Attorney, Agent, or Firm*—Michael J. Striker

[57] ABSTRACT

A machine for apportioning and packaging quantities of bulky particulate product has a weighing device (11), a conveying device (12) and a packing device (13). In order to ensure that the weighed product quantities (10) have approximately the same volume, a level sensor (32, 33), a compressing member (46) and a secondary apportioning device (50) are assigned to the conveying device. When the volume of product quantities is too large it is compressed, wherein bulky portions of the product break; when the volume is too small, a small quantity of product is added to the main quantity. In addition, an addition device (52), which supplies addition articles (53), is assigned to the conveying device.

8 Claims, 2 Drawing Sheets

MACHINE FOR APPORTIONING AND PACKAGING QUANTITIES OF FRAGILE PARTICULATE PRODUCT

PRIOR ART

The invention is based on an apportioning and packaging device according to the generic part or the main claim. Various coarse flocculent and particulate products, such as cereals and potato chips, etc., have a specific weight which fluctuates within a wide range. When such products are apportioned in quantities with a predetermined weight and packaged in packing containers of a determined magnitude, the consumer has the impression with many packages that they are not correctly filled. In addition, because of the fluctuating volume, difficulties arise in the use of flexible packaging, such as bags, when sealing and when handling the bag packaging when inserting into individual or collective boxes with a predetermined dimensioning. Therefore, it is worth striving for an apportioning and packaging machine in which a substantially uniform volume of the packages is achieved in spite of fluctuating specific weight of the quantities of packing product.

ADVANTAGES OF THE INVENTION

The device, according to the invention, with the characterizing features of the main claim, has the advantage that these quantities of breakable particulate product, which are apportioned according to weight, are given a determined volume in a simple manner by means of breaking individual pieces, or by means of compression, after weighing and prior to insertion in a packaging container, so that the individual quantities already have the desired volume when packaging.

Advantageous constructions and improvements of the device indicated in the main claim are made possible by means of the steps listed in the subclaims. It is particularly advantageous to assign a secondary apportioning device to the conveying device so that an additional portion can be added to the main quantity when the volume of the quantity of packing product is too small, in order to achieve the desired volume of the packaged quantity. In addition, other components or advertising articles can be added to the product quantities and packaged together with the latter by means of arranging an addition device at the conveying device.

DRAWING

An embodiment example of the invention is shown in the drawing and is described in more detail in the following description.

FIG. 1 shows an apportioning and packaging machine in circumferential section in simplified presentation, and FIG. 2 shows a filling height sensing device in cross section, which is assigned to the conveying device of the apportioning and packaging machine according to FIG. 1.

DESCRIPTION OF THE EMBODIMENT EXAMPLE

Figure 1:
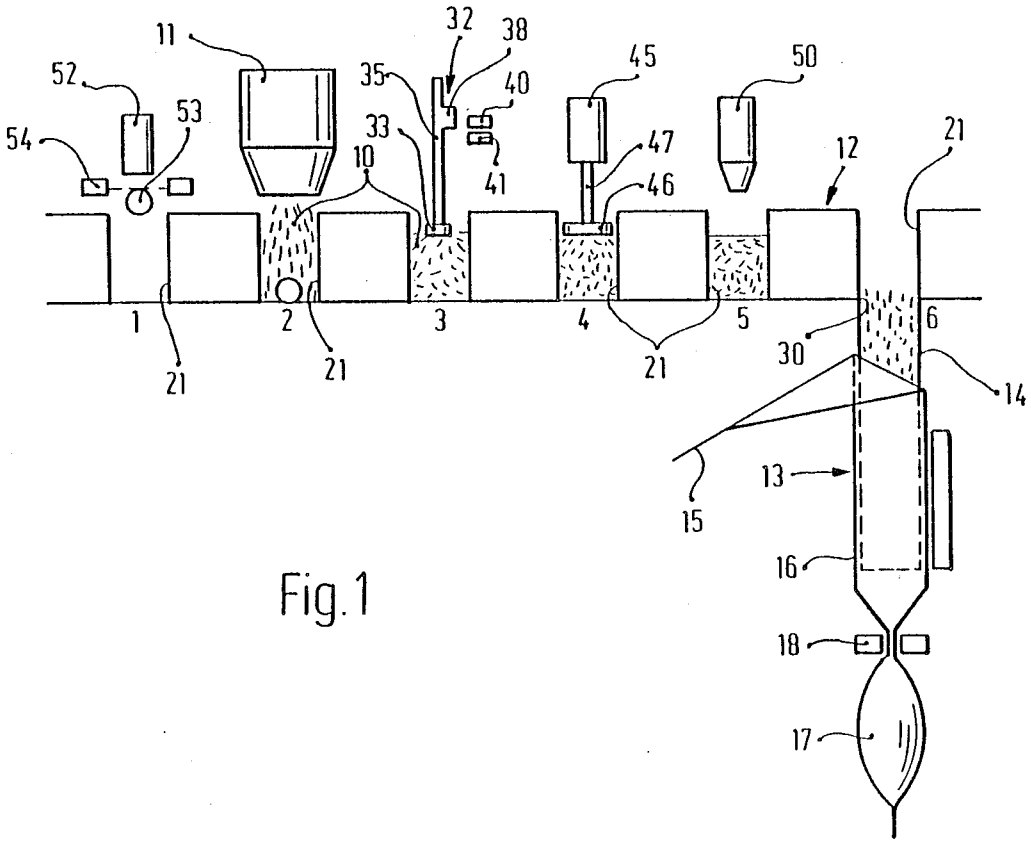
Figure 2:
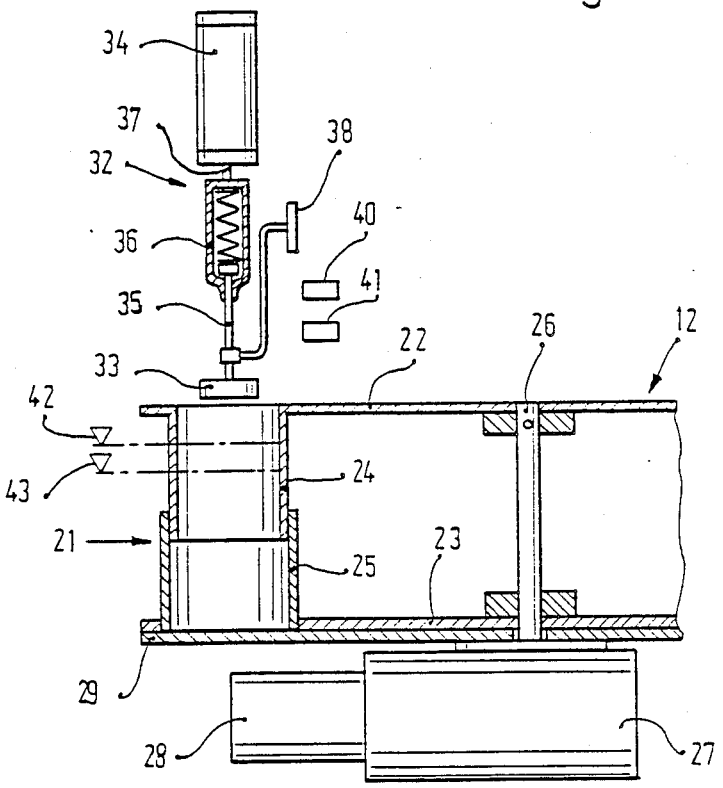

Individual quantities of packing product 10, consisting of a pourable particulate product, are apportioned one after the other according to weight by a weighing device 11 and delivered to a conveying device 12 which feeds the quantities to a packaging device 13, for example, to a bag forming, filling, and sealing machine, known per se. The latter has a vertical filling and forming pipe 14 around which a packing material sheet 15 is shaped into a tube 16 which is divided into bag packages 17 in a stepwise manner with a set of jaws 18 and is removed in a stepwise manner from the filling and forming pipe 14 through which a quantity of packing product 10 arrives in a bag package 17 which is already finished. Since the length of the removed tube 16 and, accordingly, the height of the bag packages 17 are uniform, the thickness of the produced bag packages 17, or the possibility of sealing them correctly, depends on the respective volume of the quantities of packing product 10. However, with different products consisting of particulate, bulky parts the specific weight fluctuates within a wide range.

In order that the product quantities 10, which are portioned according to weight, also have approximately equal volume for forming uniform bag packages 17, the packing product quantities 10 are not delivered directly from the weighing device 11 to the packaging device 13, but, rather, are transferred to vessels 21 of the conveying device 12 so that it is possible to process the packing product quantities 10 before they are packaged.

The conveying device 12 is preferably a revolving table which is rotated around a vertical axis in a stepwise manner and comprises an upper and lower plate 22, 23, as well as six vessels 21 which are uniformly distributed on a partial circle. The vessels 21 consist of two telescoping sleeves 24, 25, its upper sleeve 24 being securely connected with the upper plate 22 and the lower sleeve 25 being securely connected with the lower plate 23. The volume of the vessels 21 can be changed by means of axially adjusting the plates 22, 23. The upper plate 22 is securely connected with the power take-off shaft 26 of a stepping gear unit 27 which is driven by a motor 28. The cylindrical vessels 21, which are open at the top, are closed on the bottom by means of a stationary plate 29, except in the area of the packaging device 13, where the plate 29 has an opening 30.

The conveying device 12, which is rotated in a stepwise manner, passes through a plurality of—e.g., six—work stations 1 to 6, corresponding to the quantity of vessels 21. The weighing device 11 is arranged above the station 2 and pours an apportioned packing product quantity 10 into the vessel 21 located there. A sensing device 32, which monitors the filling height of the packing product quantities 10 inserted in the vessel 21, is arranged at the station 3 which follows in the conveying direction. This sensing device 32 has a feeler 33 which is dipped into the vessels from above and is lowered into the supplied vessel 21 by a pneumatic working cylinder 34 during every stoppage of the conveying device 12. The feeler 33 is fastened at a bar 35 which is connected with the piston rod 37 by means of a spring 36. Moreover, a sensing flag 38 is fastened at the bar 35 of the feeler 33 by means of a stirrup and can reach until the sensing planes 42, 43 of two approach initiators 40, 41 which are arranged so as to be spaced one above the other. The height of the approach initiators 40, 41 is adjusted in such a way that the sensing flag 38 does not arrive in the sensing area of one of the two approach initiators 40, 41 when a vessel has excess volume, that is, when the packing product quantity 10 located in the vessel 21 has a volume exceeding the required volume. On the other hand, if the feeler 33 reaches a height in the area between the filling planes 42, 43 in a vessel 21, the sensing flag 38 is located in the sensing area of the upper approach initiator 40. If the feeler 33 reaches a height at which the sensing flag 38 covers both approach initiators 40, 41, this indicates that the volume of the packing product quantity 10 located in the vessel 21 is too small. A compressor in the form of a pressing plate 46 actuated by a working cylinder 45, is assigned to the station 4 of the conveying device 12, which pressing plate 46 can be dipped into the vessel 21, which is made available at station 4, with the piston rod 47 of the working cylinder 45. If th sensing device 32 has determined a filling height of the product quantity 10 located in a vessel 21, which filling height is above the top filling plane 42, this information is stored by a switching device, not shown, and when the sensed product quantity 10 has arrived at station 4 after a conveying step of the conveying device 12, the working cylinder 45 is triggered by the switching device so that it moves the pressing plate 46 downward until a certain, predetermined height. In so doing, the product quantity 10 located in the vessel 21 is compressed, wherein portions of the breakable bulky product are broken. When a filling height is sensed between the filling planes 42 and 43, i.e. when the volume of the sensed filling quantity corresponds to the required volume, the work cylinder receives no command. If the feeler 33 is lowered to a height below the lower filling plane 43, an additional portion of the filling product is added to the sensed product quantity 10 at station 5 in order to achieve the required volume of product quantity. In addition, a secondary apportioning device 50, known per se, is assigned to the station 5 and gives a previously apportioned smaller portion to the product quantity 10 located at station 5 when triggered by means of the switching device. This portion can also be a different product component. The adjustment of the weighing device for a larger delivery quantity can also be controlled when packing product quantities having insufficient volume are repeatedly sensed.

The product quantity 10, which is supplied in a vessel 21 of the conveying device 12 of station 6, falls through the opening 30 in station 6 into the filling and forming pipe 14 of the packaging device 13 and is packaged in bags 17 in a manner known per se.

If special additions, such as coupons, advertising articles and the like, are to be added to the packing product quantities, an addition device 52, which supplies an addition article 53 to the respective vessel 21 entering station 1, is assigned to the conveying device 12 at station 1. The delivery or the presence of the addition article 53 is monitored by a checking device 54. When no addition article 53 is inserted in a vessel 21, the checking device 54 ensures, by means of a central control device, not shown, that the vessel 21 at station 2, which is not provided with an addition article is also not filled with product quantity 10.

In the embodiment example of an apportioning and packaging device described above, the compressor 46 is only actuated when the sensing device 32 determines an excess filling height. The control of the pressing plate 46 can also be effected so as to diverge from this in that the pressing plate is shifted to the vessel 21 supplied at station 4 during every working cycle of the machine. In this case the sensing device 32 only controls a secondary apportioning if the volume of the checked product quantity 10 is small relative to the required volume.

In addition, it is noted that the pressing plate 46 can also comprise downwardly projecting pins for breaking portions of a product quantity located in a vessel 21.

We claim:

1. Device for apportioning and packaging quantities of bulky, breakable particulate product comprising an apportioning device (11) for portioning the product into individual product quantities (10), a packaging device (13) for packaging said product quantities, and a conveying device (12) which is actuated in a stepwise manner and comprises vessels (21) which receive said product quantities one after the other from said apportioning device and feed said product quantities to said packaging device, characterized in that said apportioning device is a weighing device (11) which is assigned to said conveying device (12), and in that a compressing member (46), which is dipped into one of said vessels (21) located at a station (4), is assigned to said conveying device at said station (4) after said weighing device, said compressing member (46) being controlled by a filling height sensing device (32) which is arranged at said conveying device (12).

2. Device according to claim 1, characterized in that an addition device (52) for adding an addition article (53) is arranged at a station of said conveying device prior to said weighing device (11).

3. Device according to claim 1, characterized in that said compressing member is an upwardly and downwardly movable pressing plate (46).

4. Device according to claim 1, characterized in that a secondary apportioning device (50) is arranged at a station of said conveying device (12), which secondary apportioning device (50) is controlled by said filling height sensing device (32) and delivers a small quantity of product to said vessel (21) of said conveying device.

5. Device according to claim 4, characterized in that said secondary apportioning device (50) is assigned to said conveying device (12) at a station at which said packaging device (13) is arranged or at a station prior to the latter.

6. A device for apportioning and packaging quantities of bulky, breakable particulate product, comprising:

a vessel;

means for apportioning the product into a plurality of product quantities and for filling said vessel to a filling height with the product quantities individually;

means for sensing said filling height;

means responsive to said sensing means for compressing the product quantity in said vessel; and means for packaging each of the product quantities individually.

7. Device as defined in claim 6, and further comprising:

means responsive to said sensing means for adding more of the product to the product quantity already in said vessel.

8. Device as defined in claim 6, and further comprising:

means for conveying said vessel in a stepwise manner from directly under said apportioning means to directly above said packaging means.

* * * * *